US006325262B1

(12) United States Patent
Thompson

(10) Patent No.: US 6,325,262 B1
(45) Date of Patent: Dec. 4, 2001

(54) BACKPACK WITH RAM AIR CHANNEL

(75) Inventor: Jesse B. Thompson, Bozeman, MT (US)

(73) Assignee: K-2 Corporation, Vashon, WA (US)

( * ) Notice: Subject to any disclaimer, the term of this patent is extended or adjusted under 35 U.S.C. 154(b) by 0 days.

(21) Appl. No.: 09/653,077

(22) Filed: Aug. 31, 2000

(51) Int. Cl.[7] ..... A45F 3/04

(52) U.S. Cl. ..... 224/628; 224/153; 224/630; 224/631

(58) Field of Search ..... 224/628, 630, 224/631, 153

(56) References Cited

U.S. PATENT DOCUMENTS

| | | |
|---|---|---|
| 5,465,885 | 11/1995 | Wyatt . |
| 5,632,429 | 5/1997 | Cantwell . |
| 5,911,348 | 6/1999 | Shook . |
| 5,979,722 | 11/1999 | Gonzales . |

*Primary Examiner*—Gregory M. Vidovich
*Assistant Examiner*—Maerena W. Brevard

(74) *Attorney, Agent, or Firm*—Christensen O'Connor Johnson Kindness PLLC

(57) ABSTRACT

A backpack (100) including a carrying compartment (110) with a pair of shoulder straps (120) and a hip belt (128) attached thereto, for carrying the backpack on a user's back. The back portion of the backpack includes a porous outer panel (130) disposed adjacent the user's back, and an inner panel (132) that cooperatively with the outer panel, forms a pocket (131). A stiffening panel (150), generally X-shaped, is disposed in the pocket, and adapted to bow, with the center portion of the stiffening panel urged away from the user's back, creating a cooling gap (160) between the user and the carrying compartment. Air inlet ports (140) are provided near the top portion (112) of the backpack, that fluidly connect to the cooling gap. Inverted U-shaped stiffening members (142) hold the inlet ports open against gravity and aerodynamic forces. Air enters the inlet ports to the cooling gap, and exits through the porous outer panel, thereby cooling the user's back. In one embodiment of the invention an air outlet port (240) is provided near a bottom portion of the backpack, that connects to the cooling gap to encourage a greater flow of air therethrough.

21 Claims, 6 Drawing Sheets

BACKPACK WITH RAM AIR CHANNEL

FIELD OF THE INVENTION

The present invention relates to backpacks for carrying loads, and more particularly to backpacks suitable for use in strenuous activities such as biking, skating, hiking, and skiing.

BACKGROUND OF THE INVENTION

Backpacks, or knapsacks, are essentially pliable, durable bags or cases equipped with shoulder straps that allow the backpack to be worn on the back for carrying equipment, supplies, or other small articles. Backpacks are frequently used for sporting endeavors such as hiking, skating, skiing, hunting, and biking. Backpacks are also commonly used to carry electronic equipment such as radios or computers. A relatively new application for backpacks is the hydration pack, which is designed to carry a fluid, such as water, and typically includes a valve and tube leading from the fluid container to the user, that allows the user to drink while wearing the backpack on his or her back without interrupting whatever activity in which the user is engaged. The hydration pack may include additional compartments to accommodate non-fluid articles.

Because conventional backpacks are carried adjacent the user's back, thereby limiting or completely eliminating air flow thereto, the user's back is prevented or hindered from normal cooling. The backpack can become uncomfortable when worn for an extended period of time, especially if the user is engaged in a strenuous physical activity. In particular, the user's clothing, the backpack, and even the contents of the backpack, can rapidly become saturated with sweat, which does not readily evaporate under the pack. During strenuous activities, the inability of the user to efficiently discard heat may also undesirably limit the duration of the user's activities or even contribute to heat-related ailments such as dehydration or sun stroke. Ironically, when the user is engaged in strenuous activities such as bicycling, skiing, and skating (and to a lesser extent activities such as hiking), the user is generally moving rapidly with respect to the surrounding air, and therefore experiencing significant convective and evaporative cooling over some portion of the user's body. Conventional backpacks, however, block the user's back from the air flow, and prevent the back from such convective and evaporative cooling.

It may also be difficult to keep items in the backpack cool when that is desired, for example, when the backpack is a hydration pack. Significant heat may transfer to the backpack due to the close contact between the backpack and the user.

SUMMARY OF THE INVENTION

The present invention provides a backpack for carrying objects on the back of a user. The backpack includes a compartment and at least one shoulder strap attached to the compartment. The compartment has a back portion that forms a pocket between a porous outer panel located near the back of the user, and an inner panel located near the compartment. A stiffening panel is inserted into the pocket such that the stiffening panel bows outwardly (away from the user's back, in the dorsal direction) to form a cooling channel or gap between the stiffening panel and the user's back. At least one air inlet port is formed in the top end of the compartment that fluidly opens a path to the cooling gap.

In an aspect of the present invention, the motion of the user causes cooling air to flow through the air inlet port and into the cooling gap between the stiffening panel and the user's back. The porous outer panel located near the back of the user permits the air to flow out of the pocket, to cool the user.

In a preferred embodiment, the inlet port includes an inverted U-shaped stiffening member to hold the inlet port open against gravity and aerodynamic forces. The opening to the inlet port is oriented generally perpendicular to the user's direction of motion, so that the user's movement will urge cooling air into the inlet port and through the cooling gap.

In one aspect of the present invention, the stiffening panel is generally X-shaped, having upper wing portions that overlie the U-shaped stiffening member at the air inlet port, whereby an open channel is provided from the air inlet port to the cooling gap.

In another aspect of the present invention, an air outlet port is additionally provided near a bottom portion of the compartment, wherein the air outlet port fluidly connects the cooling gap to the exterior of the pocket, facilitating the outflow of air from the pocket, and thereby encouraging a larger airflow between the compartment and the user's back.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
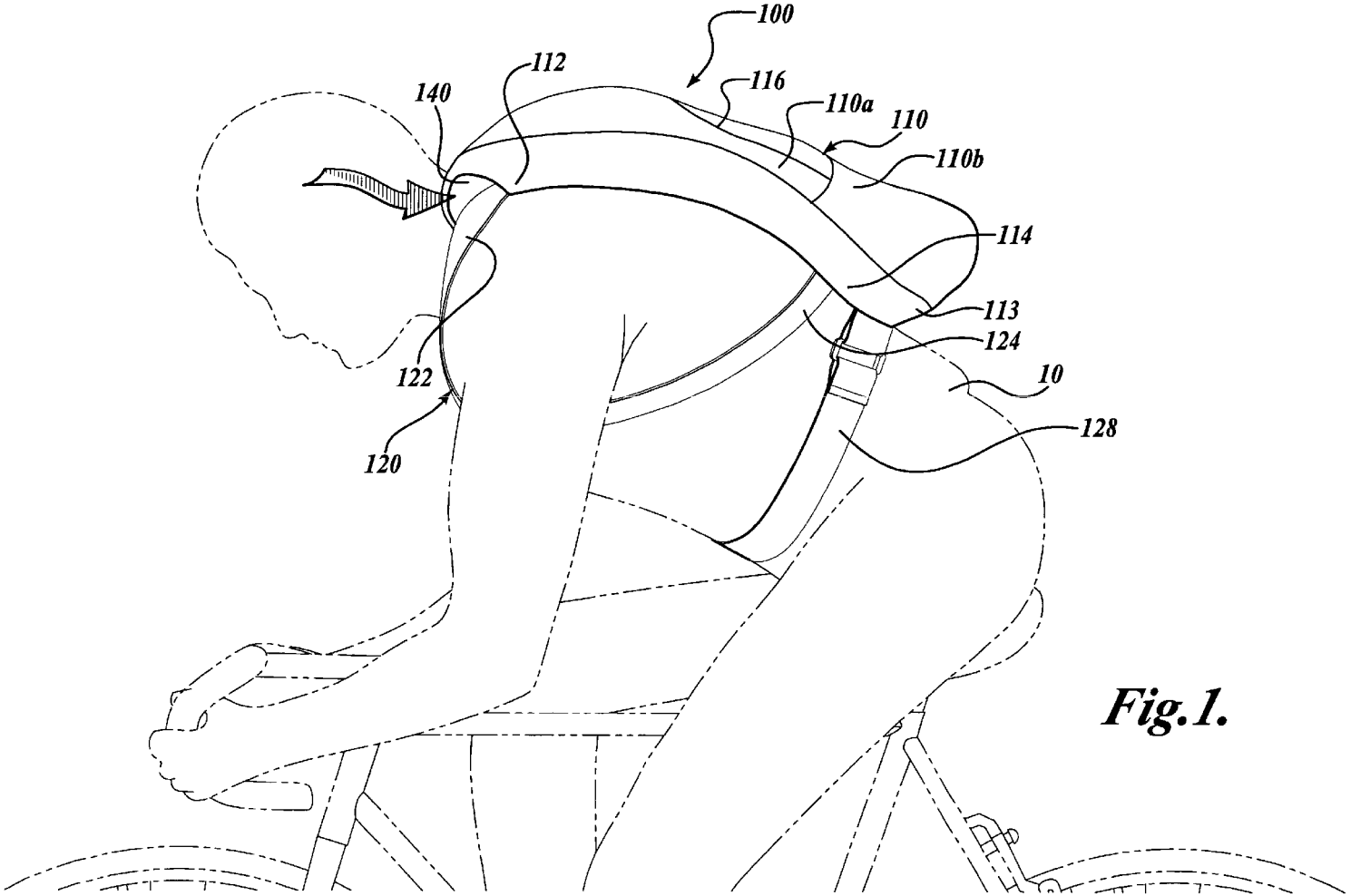
FIG. 1 is a perspective view of a first embodiment of a backpack in accordance with the present invention, shown on the back of a bicyclist.
Figure 2:
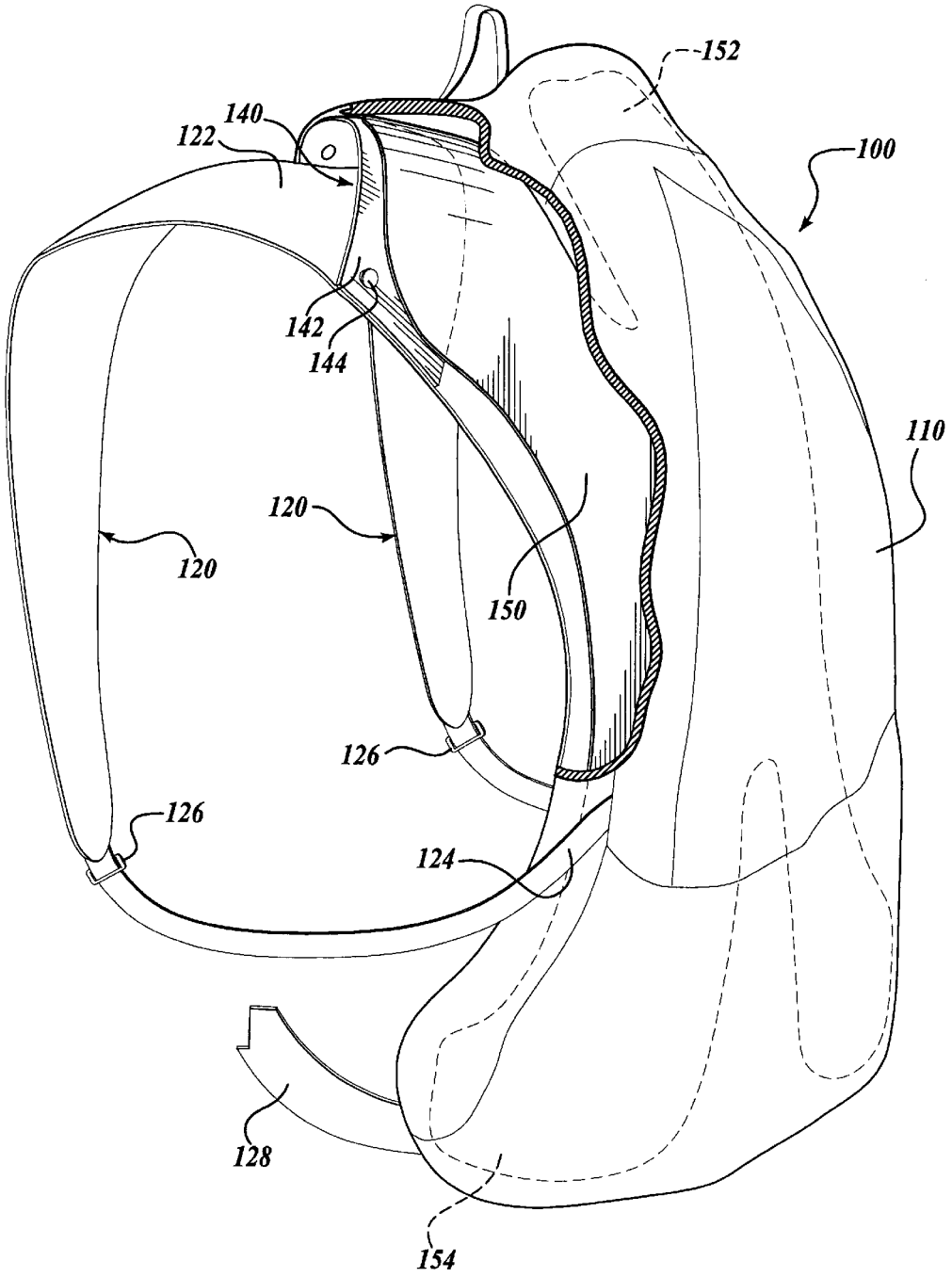
FIG. 2 is a partially cut away perspective view of the backpack shown in FIG. 1.

Referring to the figures, a preferred embodiment of the backpack of the present invention will now be described. As seen most clearly in FIGS. 1 and 2, a backpack 100 in accordance with the present invention is shown. FIG. 1 shows the backpack on the back of a bicyclist. The backpack 100 includes a carrying compartment 110, which may be of generally conventional construction, typically made from a durable flexible material such as leather, nylon, Gore-Tex® breathable fabric laminate, or any other suitable material and may be divided into a plurality of sub-compartments 110*a*, 110*b*. The carrying compartment 110 includes a zippered opening 116 for accessing the interior of the compartment 110. Although a zippered opening 116 is shown in this preferred embodiment, it will be readily apparent that any number of alternative selective opening closures could be used, including by way of non-limiting example, string ties or laces, hoop and hook type fasteners, clasps, snaps, or straps. A pair of shoulder straps 120 are attached at an upper end 122 of the straps, to a top portion 112 of the backpack 100, and at a lower end 124 to opposite side portions 114 of the compartment. The shoulder straps are provided with a buckle 126 for adjusting the length of the straps 120 to accommodate the needs and comfort of the user 10. An optional padded belt, or hip belt 128, is attached to a bottom portion 113 of the backpack 100.

Figure 3:
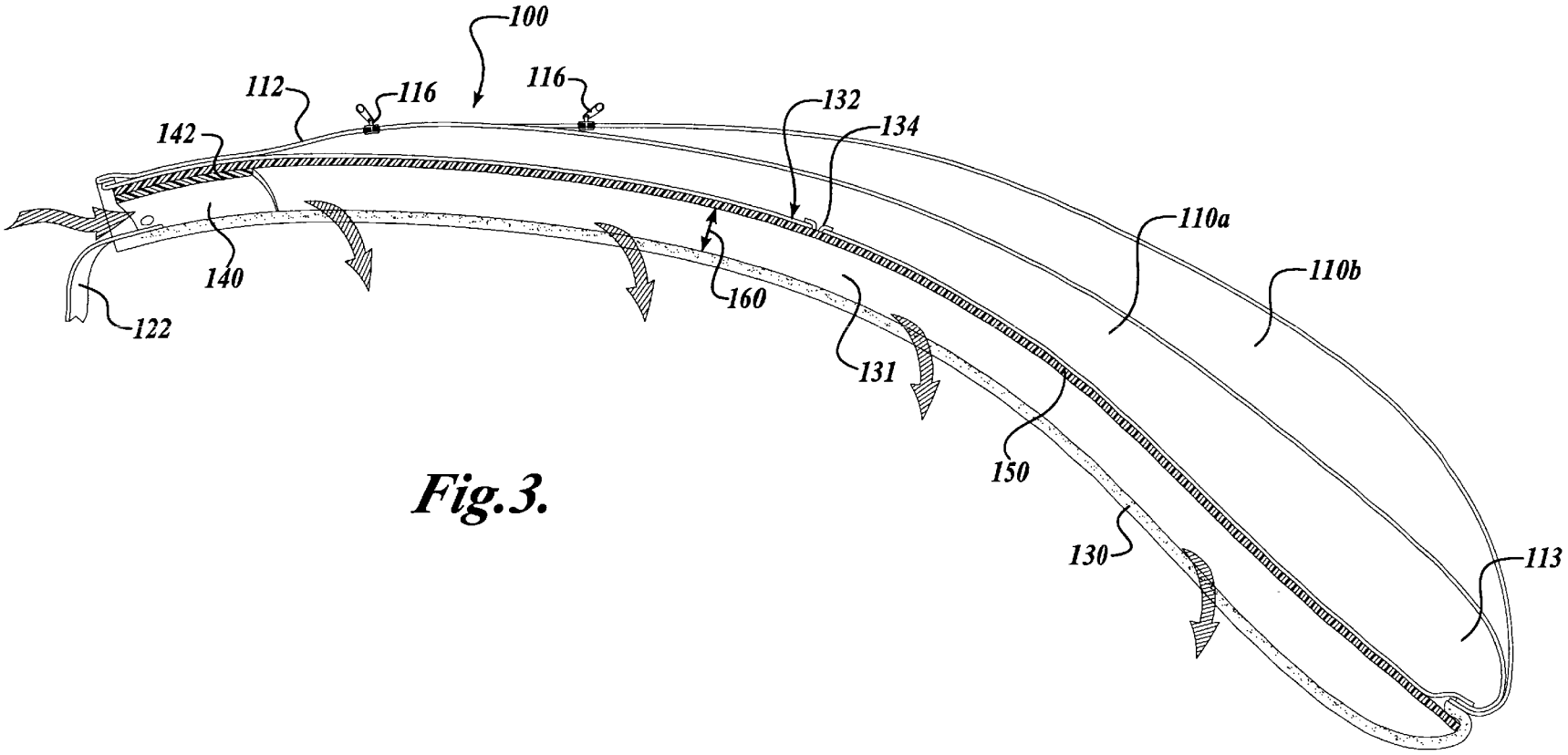
FIG. 3 is a sectional view of the backpack shown in FIG. 1 taken from the side.
Figure 4:
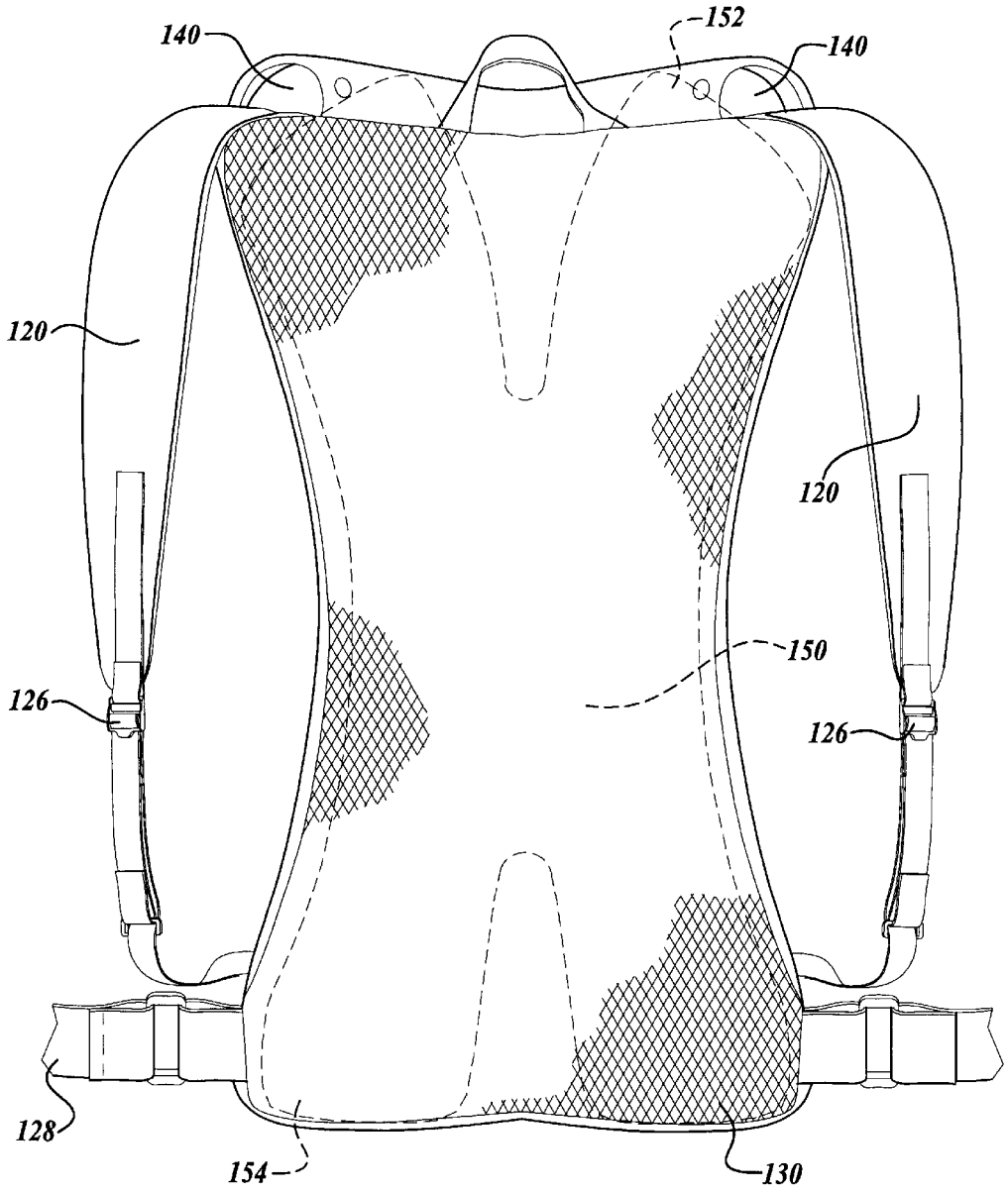
FIG. 4 is a rear view of the backpack shown in FIG. 1, with the stiffening panel shown in phantom.
Figure 5:
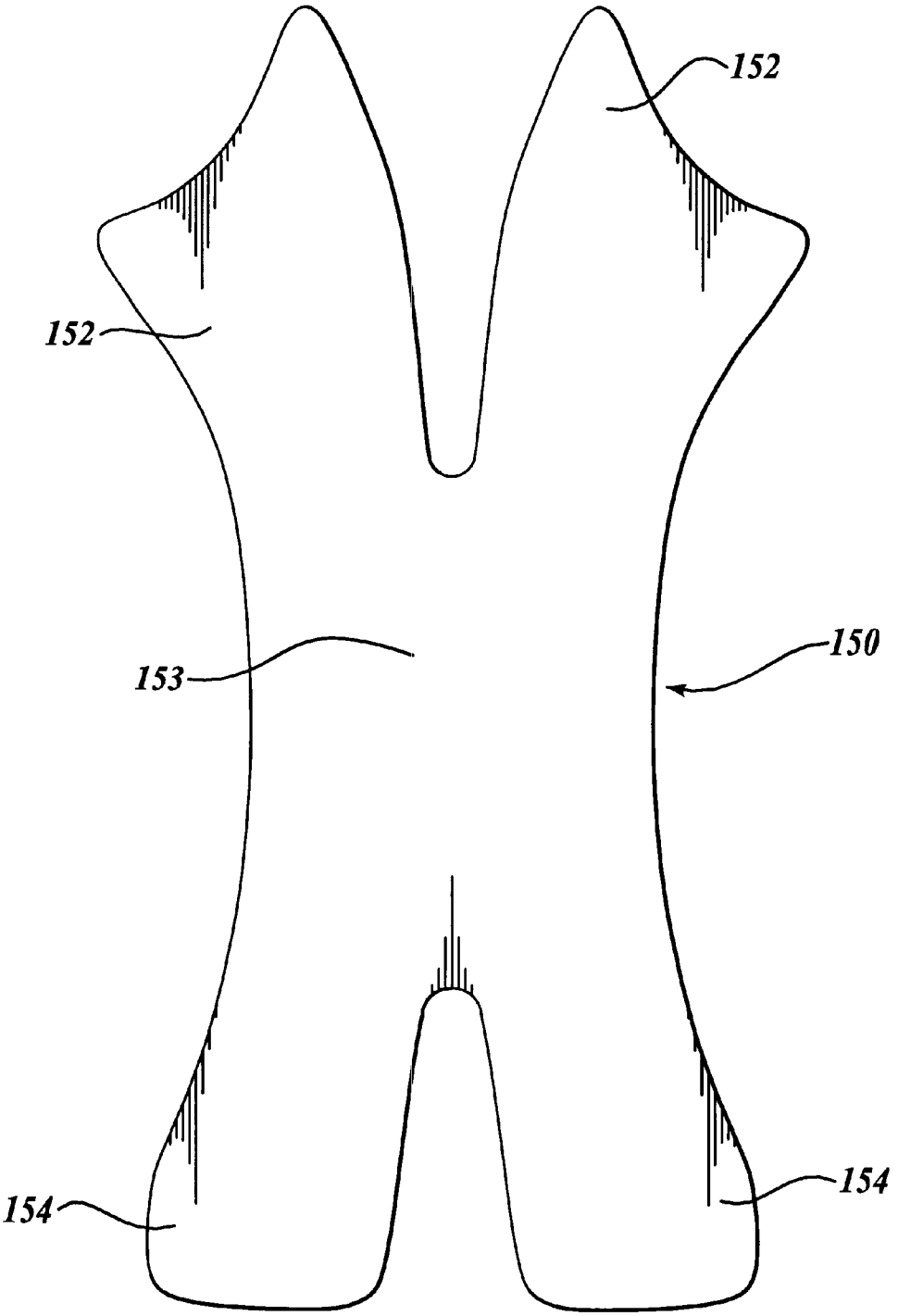
FIG. 5 is a flat plan view of the stiffening panel used in the embodiment shown in FIG. 1.

As can be most easily seen in FIG. 3 and FIG. 4, which shows a side cutaway view of the backpack 100, the back portion of the backpack 100 (the portion 10 nearest the user) has an outer panel 130 that is disposed approximately adjacent to the back of the user 10, and a generally parallel inner panel 132 attached to the outer panel 130 along its periphery, thereby forming a pocket 131 between the outer panel 130 and the inner panel 132. The outer panel 130 may incorporate a porous padded liner, to increase the comfort of the user, and/or increase the strength and durability of the outer panel. In the preferred embodiment, the outer panel 130 is attached to the inner panel 132 with stitching, although it is contemplated that any other suitable attachment is within the scope of the present invention, including removable attachments such as snaps, zippers, hook and hoop type fasteners, and laces, and more permanent attachments such as glue, heat bonding, rivets, staples, or forming the panels 130, 132, from a single piece of material. The outer panel 130, which is closest in proximity to the user's back, is preferably made from a porous or mesh material that permits air to flow therethrough.

The pocket 131 includes a large opening 134 that provides access to the interior of the pocket 131. In this preferred embodiment, the opening 134 is simply a slot between an upper portion and a lower portion of the inner panel 132.

The top portion 112 of the backpack 100 includes a pair of ram air inlet ports 140 that fluidly connect the pocket 131 to the exterior of the backpack 100. The air inlet ports 140 are generally semi-cylindrical in shape, and when the backpack 100 is properly in use, the air inlet ports 140 are disposed just above the shoulders of the user, above the shoulder strap upper end 122, opening in a generally forward direction. In this preferred embodiment the backpack 100 is intended for use with the user stooped or leaning forward, as when riding a bicycle. The air inlet ports 140 are therefore oriented with the opening generally perpendicular to the direction of forward travel when the user is in a forward-leaning position, so that the user's forward motion will usually cause air to enter the air inlet ports 140 and into the pocket 131.

In the preferred embodiment, an inverted U-shaped stiffening member 142 is attached to the inside of each air inlet port 140, to hold the air inlet port 140 open, preventing aerodynamic forces or gravity, for example, from closing the air inlet port 140. The U-shaped stiffening member 142 of the preferred embodiment is made from a strip of resilient high density polyurethane, although other suitable materials are within the scope of the present invention, including other plastics, paper-based products, metal wires or bands, and graphite composite materials. The U-shaped member 142 may be formed as a rigid molded part, to rigidly hold the air inlet port 140 open, or formed by bending a resilient, flexible strip of material, such as a strip of high density polyurethane. The U-shaped stiffening members 142 are suitably attached to the backpack 100 with rivets 144, although other attachments are also contemplated, including providing a capturing pocket or retainer in the air inlet port 140, sewing or gluing the U-shaped stiffening member in place, or providing releasable fasteners such as snaps or hook and hoop type fasteners.

It will be appreciated that when the user is moving forward at a speed sufficient to cause air to flow through the air inlet ports 140 into the pocket 131, the porous or mesh outer panel 130 permits an exit path for the air, whereby the air will flow over the back of the user.

A stiffening panel 150, sized and shaped to be insertable into the pocket 131 through the large opening 134 is also preferably provided. As shown in FIG. 4, in this preferred embodiment, the stiffening panel has a generally X-shape, including two upper wings 152, two lower wings 154 and an intermediate portion 153. The stiffening panel 150 is suitably made from a flexible, semi-rigid material such as high density polyurethane. The two upper wings 152 extend upwardly and slightly outwardly from the intermediate portion 153, and the two lower wings 154 extend downwardly and outwardly from the intermediate portion 153. The stiffening panel 150 is sized such that the wings 152, 154 extend generally to the four corners of the pocket 131. The stiffening panel 150 is preferably slightly longer vertically (or alternatively, slightly wider) than the pocket 131, whereby the stiffening panel 150 will bow when fully inserted into the pocket 131. The bowing of the stiffening panel 150 can be oriented so that a channel or gap 160 is created between the intermediate portion 153 of the stiffening panel 150 and the mesh outer panel 130 of the backpack 100. In the preferred embodiment illustrated, the upper wings 152 extend to the U-shaped stiffening members 142 of the air inlet ports 140, and slide into a position above the U-shaped stiffening members 142, thereby forming an open channel from the air inlet port 140 to the cooling gap 160. The upper wings 152 of the stiffening panel 150 are flexible so that the distal end of the upper wings 152 can flex to wrap around and approximately conform to the curved outer surface of the U-shaped stiffening members 142.

It will be appreciated that in this embodiment the air inlet ports 140 are held open to permit the inflow of air into the pocket, and that the stiffening panel 150 maintains the cooling gap 160 between outer panel 130 and the carrying compartment 110, and provides a channel from the air inlet ports 140 to the gap 160. The stiffening panel 150 also blocks or hinders the air flow from entering the carrying compartment 110, thereby tending to direct the air flow through the mesh outer panel 130 and over the user's back. Although the preferred embodiment uses a flexible stiffening panel 150, it is also contemplated that a more rigid stiffening panel, for example made from a molded plastic, could also be used, and would be within the scope of the present invention. It will also be apparent that the X-shape of the stiffening panel 150 is not critical to the present invention. Any suitable shape that can be adapted to maintain or encourage a cooling gap between the user and the compartment is also contemplated, for example rectangular, elliptical or other polygonal or curvilinear shapes can be utilized for the stiffening panel.

Although the preferred embodiment of the backpack 100 is shown with two ram air inlet ports 140, it will be appreciated that one air inlet port, or more than two air inlet ports would also function in the manner described above, and is contemplated by the present invention. A single, large air inlet port could be provided, for example, extending above and between the shoulder straps 120. Alternatively, additional ram air inlet ports could be provide generally disposed on the sides of the backpack, providing an additional flow path for air to the back of the user. It is also contemplated that the air inlet ports 140 could be moved forwardly, and rotated such that the air inlet ports 140 will face the direction of travel when the user in upright, for example during skating or skiing activities. It is further contemplated that the stiffening members 142 in the air inlet ports 140 may include an extension member that permits the user to orient opening to the inlet port to accommodate the particular activity. For example, an extension member may be pulled out to provide a forward-facing opening when the user is upright, and placed in a retracted position that provides a forward-facing opening when the user is bent over, as for example, when riding a bicycle.

While the stiffening panel has been described as retained within a pocket formed including an inner and outer panel, it should be apparent that a single panel could instead be used, with a three dimensional curved stiffening member laminated or stitched thereto. The contour of the stiffening member would then lift the longitudinal center of the back panel out of contact with the user's back, though such an embodiment is not as comfortable as the preferred embodiment. Further, other structures for creating an air flow channel are also within the present invention, such as a semi-rigid tube or a loosely coiled spring reinforced conduit incorporated into the back panel.

Figure 6:
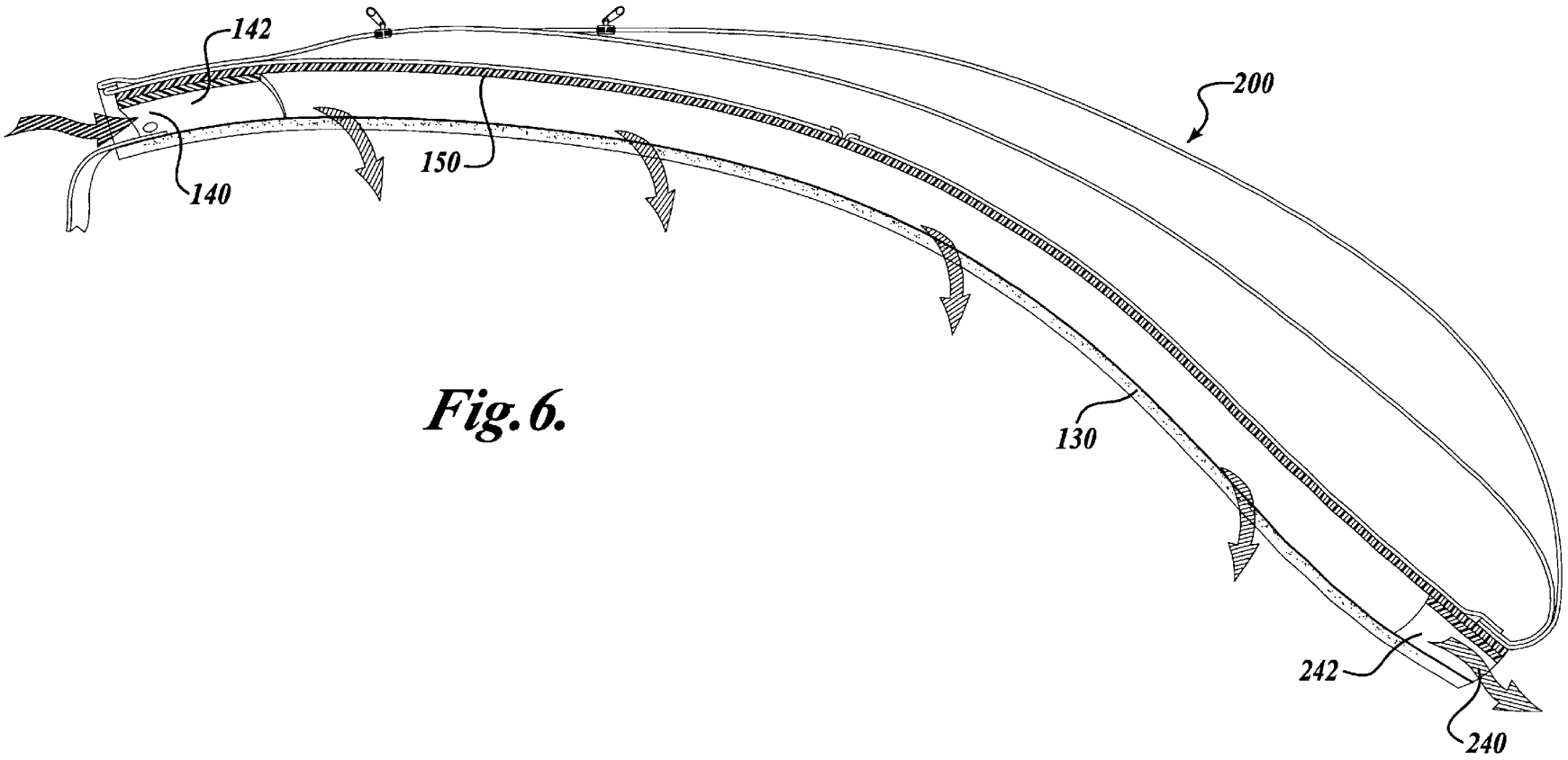
FIG. 6 is a cutaway side view of a second embodiment of a backpack in accordance with the present invention, wherein an outlet port is provided near a bottom end of the backpack.

A second preferred embodiment of a backpack 200 made in accordance with the present invention is shown in cross-section in FIG. 6. The backpack 200 is substantially similar to the first preferred embodiment 100, and additionally includes an air outlet port 240 disposed towards a lower portion of the backpack 200. The air outlet port 240 fluidly connects a bottom region of the pocket 131 to the exterior of the backpack. The air outlet port 240 optionally includes a generally U-shaped stiffening member 242 to hold the outlet port open. The air outlet port 240 provides an alternative exit for air from the pocket 131, thereby allowing more air to flow through the pocket. In such an embodiment, where an alternative air exit is provided by the outlet port 240, the inner panel of the back of the backpack need not be formed from mesh or otherwise provide air apertures. The inner panel can instead be formed of a moisture wicking material, which draws perspiration away from the wearer's back for evaporative cooling by the air stream flowing through the pack.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A backpack to be carried on the back of a user, the backpack comprising:

a) a compartment having a top end, a bottom end, and a back portion disposed between the top end and the bottom end, wherein the back portion further comprises a porous outer panel and an inner panel, the outer and inner panel cooperatively forming a pocket;

b) at least one shoulder strap having a first end attached to the compartment top end, and a second end attached to the compartment proximate the bottom end such that the backpack can be worn with the outer panel of the back portion against the user's back;

c) a stiffening panel having a top portion, a center portion and a bottom portion, the stiffening panel being located in the pocket with the top portion disposed toward the compartment top end and the bottom portion disposed toward the compartment bottom end, the stiffening panel further being adapted to bow outwardly such that the center portion is urged away from the porous outer panel forming a cooling channel therebetween; and d) a first air inlet port formed in the pocket top end fluidly connecting to the cooling channel.

2. The backpack of claim 1 further comprising a stiffening member disposed in the air inlet port, the stiffening member tending to hold the first air inlet port open.

3. The backpack of claim 1 wherein the at least one shoulder strap comprises a first and second shoulder strap, the backpack further comprising a second air inlet port wherein the first air inlet port is disposed adjacent the first shoulder strap and the second inlet port is disposed adjacent the second shoulder strap.

4. The backpack of claim 3 further comprising a first stiffening member disposed in the first air inlet port and a second stiffening member disposed in the second air inlet port, the stiffening members being generally inverted U-shaped.

5. The backpack of claim 4 wherein the stiffening panel is generally X-shaped, having a first and second upper wing and two lower wings.

6. The backpack of claim 5 wherein the first upper wing has a distal portion that partially wraps around the first stiffening member, and the second upper wing has a distal portion that partially wraps around the second stiffening member.

7. The backpack of claim 1 wherein the stiffening panel is made from a semi-rigid plastic.

8. The backpack of claim 7 wherein the pocket formed by the inner and outer panels has a maximum vertical length, and the stiffening panel has a maximum vertical length that is slightly greater than the maximum vertical length of the pocket.

9. The backpack of claim 1 further comprising a first air outlet port formed in the compartment bottom end fluidly connecting to the cooling gap.

10. The backpack of claim 9 further comprising a resilient stiffener disposed in the air outlet port, the resilient stiffener tending to hold the first air outlet port open.

11. A backpack to be carried on the back of a user, the backpack comprising:

a) a compartment defining a back portion, and top and bottom ends, the back portion including an inner panel and an outer panel;

b) at least one shoulder strap connected at first and second ends to the compartment such that the backpack can be worn with the outer panel of the back portion against the user's back;

c) a stiffening member incorporated in the back portion such that an air channel is formed between the inner and outer panels thereof;

d) a first air inlet port defined in the top end of the compartment and fluidly connected to the air channel; and e) at least one outlet port defined in the compartment, spaced from the first air inlet port, and in fluid communication with the air channel.

12. The backpack of claim 11, wherein the outlet port is defined in the bottom end of the compartment.

13. The backpack of claim 11, wherein the outlet port comprises a plurality of openings defined in the inner panel of the back portion.

14. A backpack to be carried on the back of a user, comprising:

a) a compartment defining a back portion having a longitudinal dimension and top and bottom ends;

b) at least one shoulder strap connected at first and second ends to the compartment such that the backpack can be worn with the back portion adjacent the user's back;

c) a stiffening member incorporated into the back portion to contour at least a longitudinal section of the back portion away from the user's back, defining an air channel between the longitudinal section of the back portion and the user's back;

d) a first air inlet port defined in the top end of the compartment in fluid communication with the air channel; and e) at least one outlet port defined in the compartment, spaced from the first air inlet port, and in fluid communication with the air channel.

15. The backpack of claim 14, wherein the outlet port is defined in the bottom end of the compartment.

16. The backpack of claim 14, further comprising a porous inner panel secured to the back portion and positioned against the-user's back when the backpack is worn, the air channel defined between the inner panel and the stiffening member.

17. The backpack of claim 16, wherein at least one outlet port is formed by a plurality of apertures in the inner panel.

18. A improved backpack to be carried on the back of a user of the type comprising a storage compartment having a top end disposed near a head of the user, a bottom end disposed opposite the top end, at least one strap for securing the backpack to the user, and a back panel disposed adjacent the back of the user, the improvement comprising a pocket in the back panel having a porous outer panel and a stiffening member disposed in the pocket, the stiffening member adapted to urge the storage compartment away from the back of the user such that a cooling gap is created between the stiffening member and the porous outer panel, and at least one air inlet port in the upper end of the compartment that fluidly connects to the cooling gap such that forward motion of the user will tend to cause air to flow into the cooling gap.

19. The improved backpack of claim 18 further comprising at least one air outlet port in the bottom end of the storage compartment fluidly connecting to the cooling gap.

20. The improved backpack of claim 18 further wherein the air inlet ports comprise resilient plastic members having a generally semi-cylindrical shape.

21. The improved backpack of claim 18 wherein the stiffening member is generally X-shaped.

* * * * *